US006078249A

United States Patent [19]

Slavik et al.

[11] Patent Number: 6,078,249

[45] Date of Patent: Jun. 20, 2000

[54] SCREW-TYPE POTENTIOMETER DRIVE WITH A TRAVEL RESET

[75] Inventors: Scott A. Slavik; Yan Rodriguez, both of Pace, Fla.

[73] Assignee: Wayne-Dalton Corp., Mt. Hope, Ohio

[21] Appl. No.: 09/168,654

[22] Filed: Oct. 8, 1998

[51] Int. Cl.[7] ..... H01C 10/40

[52] U.S. Cl. ..... 338/180; 338/DIG. 1; 338/118

[58] Field of Search ..... 338/160, 176, 338/180, 181, 118, DIG. 1, 116

[56] References Cited

U.S. PATENT DOCUMENTS

| | | | |
|---|---|---|---|
| 1,955,906 | 4/1934 | Crouse | 338/101 |
| 3,179,910 | 4/1965 | Grunwald | 338/180 |
| 3,360,755 | 12/1967 | Olson | 338/116 |
| 3,497,858 | 2/1970 | Norris | 338/180 |
| 3,676,825 | 7/1972 | Olson | 338/181 |
| 3,815,076 | 6/1974 | Aoki | 338/180 |
| 3,982,220 | 9/1976 | Rozema et al. | 338/174 |
| 3,987,389 | 10/1976 | Nishioka et al. | 338/180 |
| 4,004,264 | 1/1977 | Hogue et al. | 338/174 |
| 4,114,132 | 9/1978 | DeRouen et al. | 338/174 |
| 4,114,133 | 9/1978 | Stephens | 338/174 |
| 4,132,972 | 1/1979 | Tumbusch | 338/180 |
| 4,357,591 | 11/1982 | Gray | 338/162 |
| 4,672,858 | 6/1987 | Langowski | 74/424.8 |
| 4,771,262 | 9/1988 | Reuss | 338/162 |

FOREIGN PATENT DOCUMENTS

| | | | |
|---|---|---|---|
| 637767 | 3/1962 | Canada | 338/180 |

*Primary Examiner*—Karl Easthom

*Attorney, Agent, or Firm*—Renner, Kenner, Greive, Bobak, Taylor & Weber

[57] ABSTRACT

An assembly (24) for monitoring the travel of a device includes a potentiometer (26) having a slide bar (32). The potentiometer generates a resistance value according to a position of the slide bar which is coupled to the door through a rotatable member (40) carried by a bracket (34). A slide rack (36) is carried by the bracket and is coupled to both the slide bar and the rotatable member. The slide rack operatively engages the rotatable member between predetermined first and second positions and operatively disengages from the rotatable member when at the first and second positions.

10 Claims, 4 Drawing Sheets

SCREW-TYPE POTENTIOMETER DRIVE WITH A TRAVEL RESET

TECHNICAL FIELD

Generally, the present invention relates to controlling the movement of a slide member of a potentiometer. More particularly, the present invention relates to potentiometer assemblies which limit the amount of slide member travel. In particular, the present invention relates to a potentiometer assembly that prevents damage caused by driving the potentiometer slide member beyond its limits by disengaging the slide member as the limit is reached and re-engaging the slide member when its direction is reversed.

BACKGROUND ART

The use of a potentiometer to determine the position of a connected device has proven to be rather accurate. The potentiometer employs either a rotary or a linear slide member connected to a variable resistor that changes resistance to be equated to the position of the device that is monitored. If the travel of the monitored device is greater than the travel of the slide member, gearing has been used to match the travel of the slide member to the travel of the monitored device. This application is accurate as long as the two devices are mechanically attached so that each increment of movement of the monitored device has a resistance change in the potentiometer and each position of the monitored device has a resistance value that is always the same for that position. If the devices are separated, for service or repair, the slide member must be reset to match the original position of the monitored device to the original resistance value for that position. Some applications can use a setup routine to move the slide member to the proper position, but if the potentiometer is not in the correct position at the beginning of the setup routine, the drive can bottom out or exceed the travel of the slide member before the correct resistance is found. When this occurs, the potentiometer can be damaged and must be replaced.

Known potentiometers may have dead spots or areas of no resistance change at either end of their travel. These dead spots can be misinterpreted by the control monitoring the potentiometer, as a no-movement condition of the potentiometer even though the slide in the potentiometer is continuing to move. A control unit can be programmed to recognize this condition as the movement limits of the monitored device, but the potentiometer must be preset to the correct position for this to be true. Being able to automatically disengage the potentiometer drive is necessary to prevent damage and if the potentiometer is enclosed and not readily accessible, it is necessary to have the ability to automatically reset the potentiometer travel to be within the travel of the monitored device and program the controls to accept the resistance output as the movement profile of the monitored device. Various attempts have been made to overcome the aforementioned problems as evidenced by the following patents.

U.S. Pat. No. 4,004,264 to Hogue et al. shows a variable resistance device of the type wherein a worm screw is utilized to move a contact bearing member through a path of travel relative to conductive and resistive tracks. The variable resistor includes a ratchet member having a single elongated spring section attached to a body portion. The body portion has two rigid legs extending therefrom. The spring portion of the ratchet member is disposed within a groove formed in a surface of the contact bearing member. The rigid legs of the ratchet member are the sole elements in contact with the worm screw when the contact member reaches the end of its travel relative to the resistive and conductive tracks. This method lacks the ability to reset the position of the ratchet member to the body portion.

U.S. Pat. No. 4,114,133 to Stephens discloses a worm gear drive and ratchet system in which a flexible, two-piece, toothed drive wheel is driven by a threaded drive shaft. The two-piece, toothed drive wheel comprises identical halves that are keyed and bonded into a fixed relationship. Upon reaching a stop, gear teeth embossed on the flexible drive wheel ratchet over the threads on the threaded drive shaft. This method does not provide adequate engagement to maintain positive location of the drive wheel and will not reset the position of the drive wheel.

U.S. Pat. No. 4,114,132 to DeRouen et al. teaches a lead screw type control for a miniature worm gear actuated potentiometer having a rotor with a main drive spur gear and a ratcheting drive rack gear. The invention contemplated rack gear teeth formed with a gentle ramp opposed to a more acute ramp such as to resemble a saw-tooth configuration in profile. The main drive spur gear is formed on less than the total of the rotor circumference. The ratcheting rack gear is mounted on a portion of the rotor circumference that does not include the spur gear. The main drive spur gear teeth are functional in a plane perpendicular to the plane in which the ratcheting rack gears are effective. Ratcheting is accomplished when the driving lead screw has driven the main-drive spur gear to one of its limits in either a clockwise or counterclockwise direction. At this point, if the same direction of rotation is continued, the ratcheting rack gear is urged into engagement with the driving lead screw by the force of a contact spring. As long as the same direction rotation of the driving lead screw is maintained, the engagement continues so as to permit continued ratcheting and thus rotation of the worm gear without causing damage to the movable parts of the worm gear actuated potentiometer. This device is complicated and has too many parts. Further, it relies on a spring to urge a ratcheting gear into engagement with the driving lead screw to prevent damage to the moveable parts.

U.S. Pat. No. 4,771,262 to Reuss teaches a drive means of a rotary potentiometer that is arranged to work trouble-free in the case of misalignment between the rotary axis of the rotating body and the rotary axis of the driving member. Teeth are arranged in the rotating, or rotary body, the crests of the teeth are directed to the rotary axis. The driving member is adjacent to the one flank of the one tooth and the one flank of the other tooth. The flanks of the teeth are involutely rounded off, so that the applied torque remains substantially constant in the event of any misalignment of the driving member axis with respect to the body axis. This method provides a means of driving a rotary potentiometer in a misaligned condition and does not provide a method of resetting the potentiometer in the event it over drives the limits.

U.S. Pat. No. 4,357,591 to Gray discloses a trimmer potentiometer or a like variable resistor, which has a worm gear driving an elastomeric worm wheel carrying a wiper contact to slide on an arcuate resistance element. The worm wheel has gear teeth formed on circumferentially-spaced rim sections projecting cantileverwise from an axially thick unbroken rim of a radial flange on the main body of the wheel, some sections having only a few gear teeth and being separated by other sections having larger numbers of gear teeth. The extent of rotation of the wheel is limited to less than 360 degrees, and the sections with few teeth are arranged to be in mesh with the worm at the limits of wheel rotation so as to give a de-clutching effect by inward deflection of these sections on over rotation of the worm. This method relies on yieldable teeth of an elastomeric worm wheel to give a de-clutching effect at the limits of the wheel rotation and does not provide a method of resetting the potentiometer.

U.S. Pat. No. 3,982,220 to Rozema et al. provides a variable resistance control containing a one-piece stamped mounting bracket having an integral collector ring for positioning a rotatable gear and having a pair of integral yokes for aligning a lead screw in driving relationship with the rotatable gear. Contactor constrained to rotate with the gear wipingly engages a resistance element. Each of the yokes comprises a pair of arms arcuately clinched around the lead screw to secure the lead screw to the mounting bracket. Integral with the gear are two outwardly extending resilient fingers for engagement with a respective one of the yokes to arrest rotation of the gear. Continued rotation of the lead screw after rotation of the gear has been arrested flexes the resilient finger toward the lead screw for driving the gear out of engagement with the lead screw. An aperture is provided in the lead screw for insertion of a shaft or tool for remote actuation of the control or for actuation of another control. This method appears to apply to both linear and rotary potentiometers and will protect over travel by disengaging the gear from the lead screw by driving the gear out of engagement without having the ability to reset the position of the gear to the travel of the potentiometer.

U.S. Pat. No. 4,672,858 to Langowski teaches a nut/clutch assembly for a rotary power screw, such as a linear actuator power screw, is disclosed in which the power screw is selectively rotated in one direction or the other, and in which the power screw has a pair of stops spaced apart from one another and which are rotatable with the power screw. A nut is provided having a central opening threadably engageable with the power screw, and the nut is threadably movable in axial direction along the power screw upon rotation of the latter. The nut has a circumferential groove thereon, and this groove has a base and a pair of spaced side walls. A collar is slidably received within the circumferential groove, and the collar is resiliently clamped onto the nut such that the collar frictionally engages the grooved base with a desired frictional force so as to permit the nut to rotate relative to the collar upon the nut being rotatably driven by the screw, and upon the collar being held in fixed rotary position. The collar is secured to a portion of its application in such a manner as to prevent rotation of the collar and so as to transmit linear force between the application and the power screw. The collar is somewhat narrower than the circumferential groove in the nut so that upon the nut moving axially along the power screw and upon the collar being coupled to the application, the collar resists axial movement of the nut and frictionally engages one of the side walls of the groove, thereby to hold the nut against turning with the power screw, and further to ensure axial movement of the nut together with the collar along the power screw. When the nut engages one of the stops, the nut is positively rotated with the power screw and the collar held by the application turns relative to the nut so as to serve as a clutch. This method does not reset the nut to its proper location. This device has many parts and requires close tolerances to function properly. Further, the nut rotates with the power screw, requiring a groove to transfer the motion to a stationary potentiometer. The interface between the nut and the potentiometer must have a bearing surface.

There are electromechanical devices such as limit switches to shut off the drive prior to the potentiometer reaching its limit, however, the nut would then need to be reset or positioned manually by a service repair person.

DISCLOSURE OF INVENTION

Therefore, an object of the present invention is to provide a potentiometer coupled to a moving object. A further object of the present invention is to provide a potentiometer coupled to a moving object that cycles between a first and a second position, such as an open and closed position of a garage door. Another object of the present invention is to couple the potentiometer to the moving object or a device responsible for causing the movement of the object. Still another object of the present invention is to provide a potentiometer that is coupled to a motor that drives the door between the first and second positions.

Another object of the present invention is to accommodate over-travel of the moving object so that no damage is done to the potentiometer. A further object of the present invention is to provide a housing which converts rotational movement to linear movement. Still yet another object of the present invention is to stop conversion of the rotational movement to linear movement at predetermined positions. Still yet another object of the present invention is to provide a threaded shaft which moves a slide rack that disengages from the threaded shaft at the predetermined positions, which in turn, stops moving a slide member of the potentiometer. A further object of the present invention is to allow for resetting or servicing of a motor that moves the door without concern as to the position of the slide member of the potentiometer when the resetting or servicing is complete.

Another object of the present invention is to provide a bracket which carries the potentiometer, a slide rack, and a pinion gear which provides the threaded shaft. Still yet another object of the present invention is to rotate the pinion gear with the drive motor such that the threaded shaft is carried by the bracket. Still a further object of the present invention is to use the bracket to support the slide rack which has a deflectable threaded section that is engaged by the threaded shaft. Still yet another object of the present invention is to configure the threaded shaft and deflectable threaded section so that as the threaded shaft rotates, the slide rack moves which in turn moves the slide member of the potentiometer. When the slide rack reaches the end of its travel, the deflectable threaded section is deflected downwardly to allow rotation of the pinion gear without transferring movement to the slide member of the potentiometer. Still yet another object of the present invention is to allow for automatic resetting of the potentiometer after servicing of the motor and/or door.

In general, the present invention contemplates an assembly for monitoring the travel of a device, comprising a potentiometer having a moveable member, the potentiometer generating a resistance value according to a position of the moveable member; a bracket coupled to the potentiometer; a rotatable member carried by the bracket, the rotatable member coupled to the device; and a slide rack carried by the bracket, the slide rack coupled to the moveable member and the rotatable member, wherein the slide rack is operatively engaged with the rotatable member between predetermined first and second positions and operatively disengaged from the rotatable member at the first and second positions.

BEST MODE FOR CARRYING OUT THE INVENTION

Figure 1:
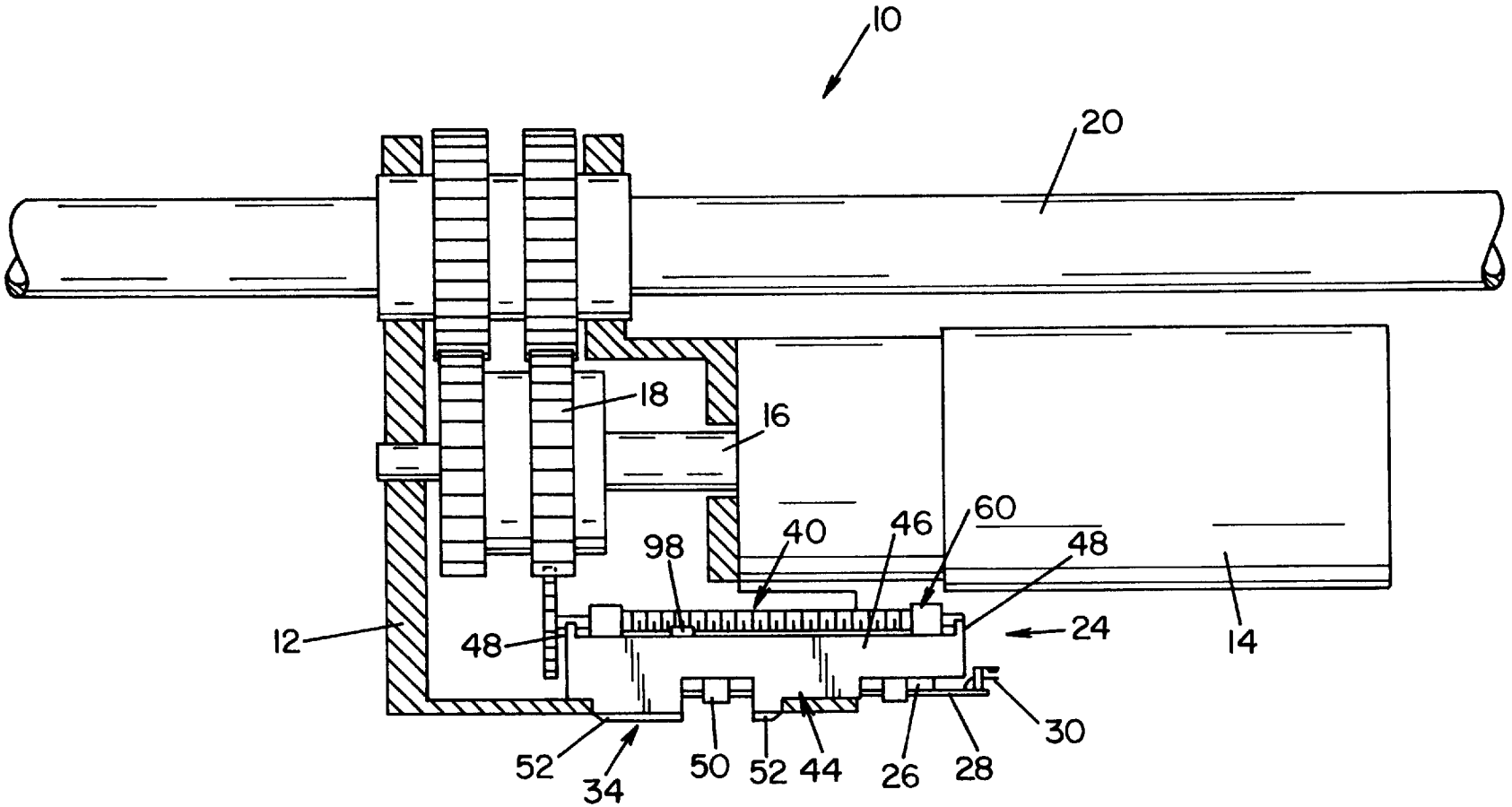
FIG. 1 is a schematic view showing a garage door operator system coupled to a potentiometer assembly of the present invention.
Figure 2:
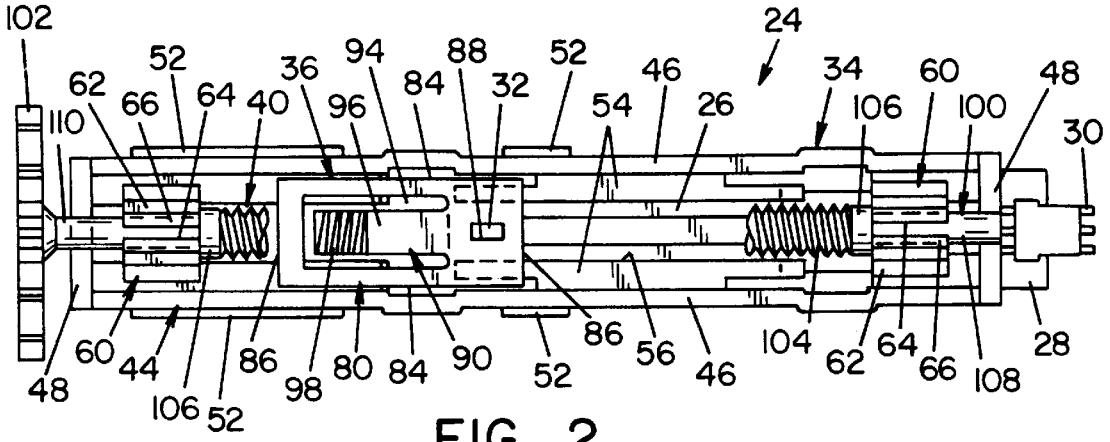
FIG. 2 is an enlarged plane view partially in section of the potentiometer assembly.
Figure 3:
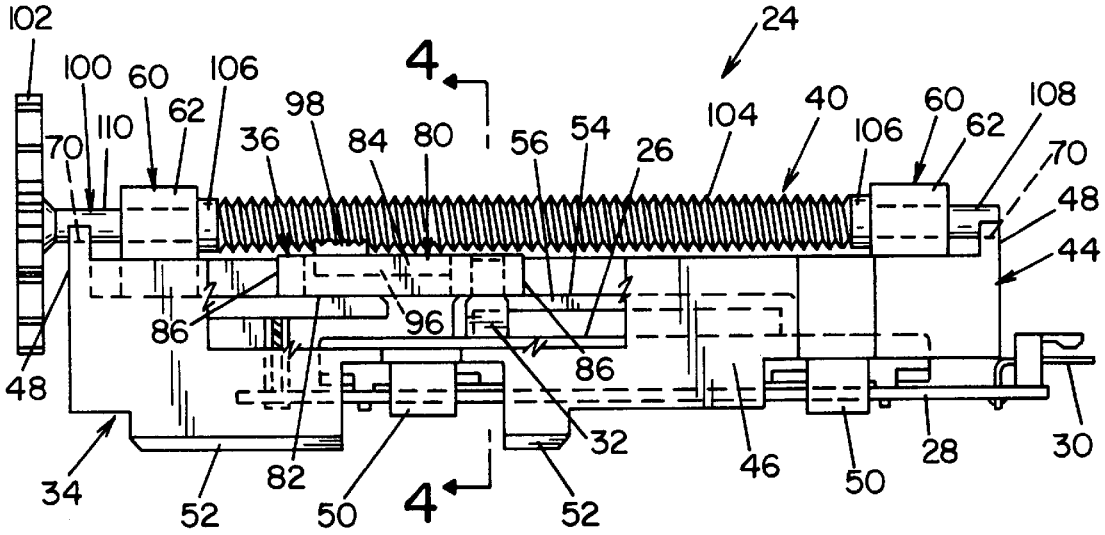
FIG. 3 is an elevational view partially in section of the potentiometer assembly thereof.
Figure 4:
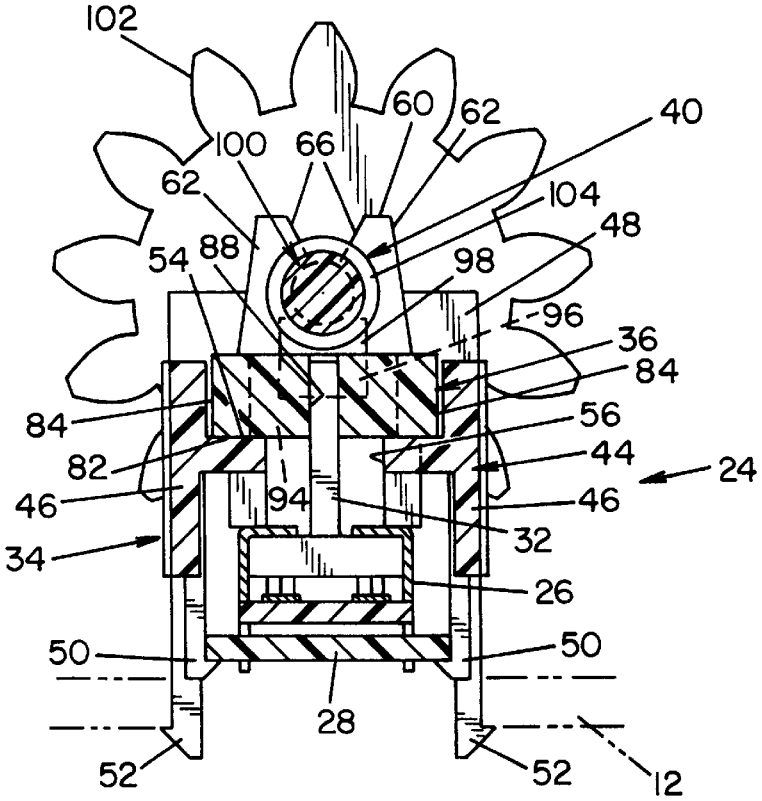
FIG. 4 is a further enlarged cross-sectional view of the potentiometer assembly taken along line 4—4 of FIG. 3.

A garage door operator system for moving a garage door from an open to a closed position is generally indicated by the numeral 10 in FIG. 1. It will be appreciated that the concepts of the present invention are equally applicable to other moveable enclosures such as gates and the like. As best seen in FIG. 1, a bracket 12 supports components of the system 10 in a manner well known in the art. The system 10 includes a motor 14 which converts electrical energy into mechanical energy. In particular, the motor 14 rotates a drive shaft 16 which engages a drive gear 18 that controls the drive tube 20. The drive tube 20 is carried by the bracket 12 and functions to lift and lower the door in a manner well known in the art. Generally, the motor 14 is controlled by a processor (not shown) which keeps track of the motor speed and/or forces applied to the door at various positions throughout the travel of the door. The forces applied to the door can be obtained by sensors coupled to various elements of the operator system, by monitoring the speed of the motor shaft with a pulse counter or the like, or by determining the torque applied to the drive shaft 16. Such a control system is disclosed in U.S. patent application Ser. No. 08/906,529 owned by the Assignee of this application and which is incorporated herein by reference.

Figure 6:
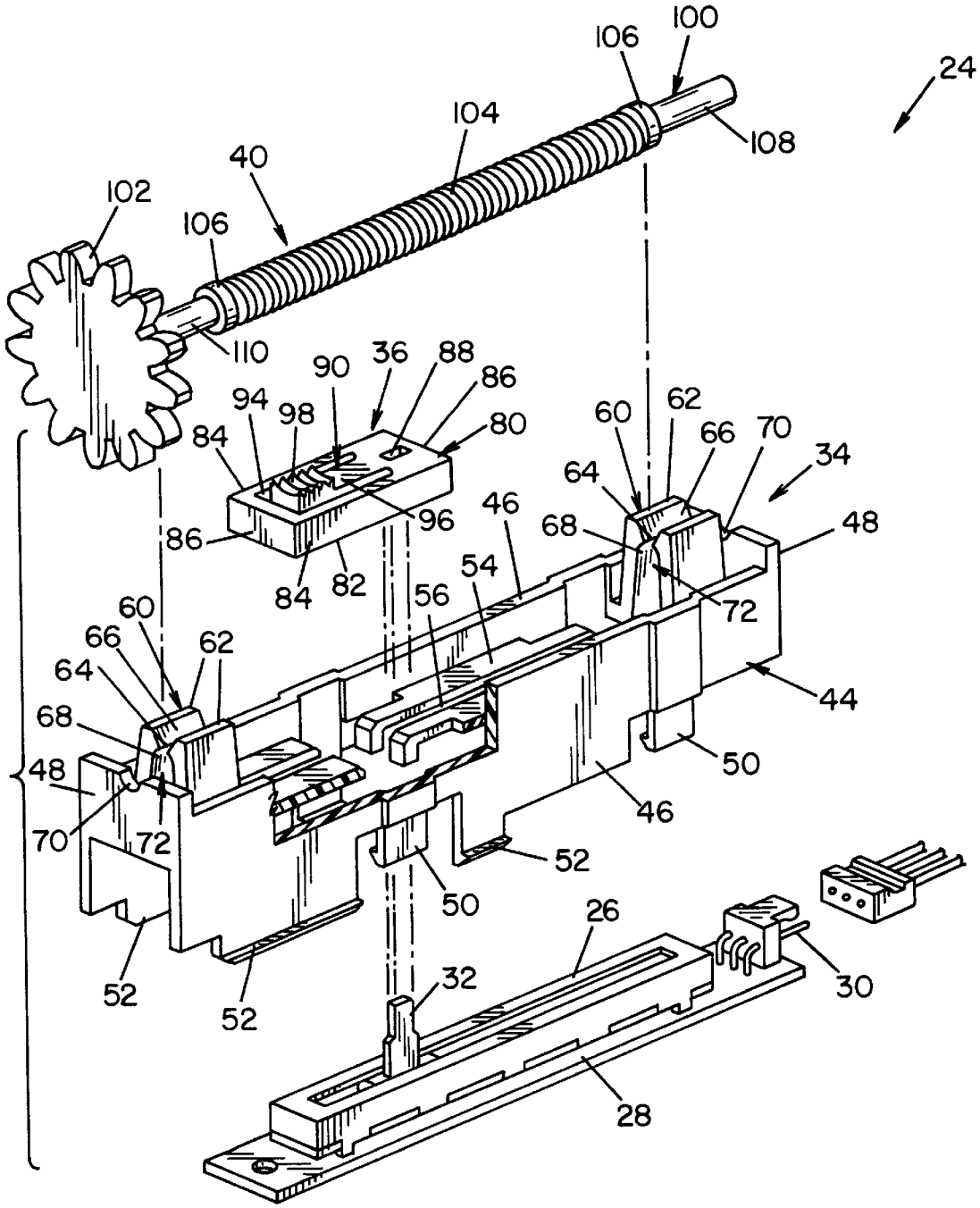
FIG. 6 is an exploded, perspective view of the potentiometer assembly.

As best seen in FIGS. 1 and 6, a potentiometer assembly, designated generally by the numeral 24, is coupled to the operator system 10. In particular, the assembly 24 is coupled to the drive gear 18 which is carried by the bracket 12. The bracket 12 may be configured to also carry the potentiometer assembly 24 or the assembly 24 could be carried by structure surrounding the operator system 10. It will also be appreciated that the potentiometer assembly 24 could be coupled to any moving part of the operator system or the door. The potentiometer assembly 24 is employed to correlate door positions with the speed or force of the door, whereupon the processor determines the presence of an obstruction and/or other problems associated with the travel of the door. As will become apparent as the detailed description proceeds, the potentiometer assembly 24 is employed to develop a resistance change per unit of travel that is associated with the movement of the door.

Generally, the potentiometer assembly 24 includes a linear potentiometer 26 mounted on a circuit board 28. A pair of wire leads 30 are electrically connected to the circuit board 28 and are employed to transmit a change in resistance value to the processor which in turn determines a position of the door. A slide bar 32 extends from the linear potentiometer 26 and provides a resistance change per unit of travel when moved. Accordingly, at one end of the linear potentiometer 26, the slide bar 32 exhibits a low resistance value and at the opposite end of the linear potentiometer the slide bar 32 exhibits a high resistance value. Positional increments of the slide bar 32 correlate to corresponding incremental changes in resistance associated with the door position.

As seen in FIGS. 2–6, a potentiometer bracket 34 is mounted on the circuit board 28 and may also be secured to the bracket 12. A slide rack 36 is carried by the bracket 34 and coupled to the slide bar 32. A threaded pinion gear 40 is coupled to the slide rack 36 and rotatably received upon the potentiometer bracket 34. Briefly, rotation of the drive gear 18 causes rotation of the pinion gear 40. Rotational movement of the pinion gear 40 causes linear movement of the slide rack 36 and in turn, the slide bar 32. Accordingly, a position of the door can be correlated to the resistance value generated by the potentiometer 26.

The potentiometer bracket 34 includes a housing 44 which has opposed sidewalls 46 connected at each respective end by opposed end walls 48. In the preferred embodiment, the potentiometer bracket 34 is made of a polycarbonate material; however, other thermoplastic or thermoset materials could be used. Extending downwardly from the sidewalls 46 are a plurality of board flanges 50 that snap fit onto the circuit board 28 to securely hold it in place. Also extending downwardly from the sidewalls 46 are a plurality of mount flanges 52 which engage and hold onto the bracket 12. This allows for secure connection of the potentiometer assembly 24 to the bracket 12. Extending inwardly from the sidewalls 46 is a rack ledge 54 which has an opening 56 therethrough. The rack ledge 54 slidably supports the slide rack 36 while the opening 56 allows for unencumbered movement of the slide bar 32. It will appreciated that the slide rack 36 is sized to allow for free, controlled linear movement along the length of the rack ledge 54. The housing 44 provides a pair of shaft supports 60 at about each end thereof. Each shaft support 60 has a pair of opposed deflectable prongs 62 that extend upwardly from the rack ledge 54. Each prong has a detent 64 facing the opposed prong 62. Each detent comprises a ramp 66 which is directed toward the opposite prong. The ramp 66 transitions to a shaft surface 68 which is directed away from the opposite prong. Each end wall 48 has a notch 70 that together with the shaft surface 68 forms a shaft opening 72.

The slide rack 36, which is received between the sidewalls 46 and rests upon the rack ledge 54, includes a block 80 having a bottom slide surface 82 that bears against the rack ledge 54. The block 80 also includes a pair of opposed sidewalls 84 connected at each end by a pair of opposed stops 86. Extending through the block 80 is a bar opening 88 that is alignable with the opening 56. Accordingly, the bar opening 88 receives the slide bar 32. The block 80 provides a deflectable member 90 that engages the pinion gear 40. The block 80 provides a u-shaped opening 94 which forms a tongue 96. Extending upwardly from the tongue 96 is a threaded section 98 which extends above the top of the block 80. Accordingly, the deflectable member 90 is made up of the tongue 96 and threaded section 98 which is moveable within the u-shaped opening 94.

The pinion gear 40 includes a shaft 100 which has a gear 102 at one end. The gear 102 engages the drive gear 18 of the operator system. The shaft 100 provides an integrally threaded shaft 104 which has a collar 106 at each end thereof. A distal end 108 is provided at the end of the shaft 100 while a proximal end 110 is provided between the gear 102 and the adjacent collar 106.

To complete assembly of the potentiometer assembly 24, the slide rack 36 is placed on the rack ledge 54 such that the slide bar 32 extends through the opening 56 and into the opening 88. As a precaution, the slide rack 36 may be moved along the surface of the rack ledge 54 to ensure that there are no interferences with the movement of the slide rack 36 and the slide bar 32. Next, the pinion gear 40 is mounted upon the housing 34. In particular, the distal end 108 and the proximal end 110 are inserted into the shaft supports 60. The prongs 62 are deflected outwardly by pressing the distal end 108 and the proximal end 110 to engage the corresponding ramps 66 and push the prongs 62 away from one another. As the ends 108 and 110 pass over the ramps 66, the prongs return to their original position and the distal end 108 and the proximal end 110 rest on respective notches 70. As such, the shaft 100 rotates within the shaft openings 72. This also allows engagement of the threaded shaft 104 with the threaded section 98.

Figure 5:
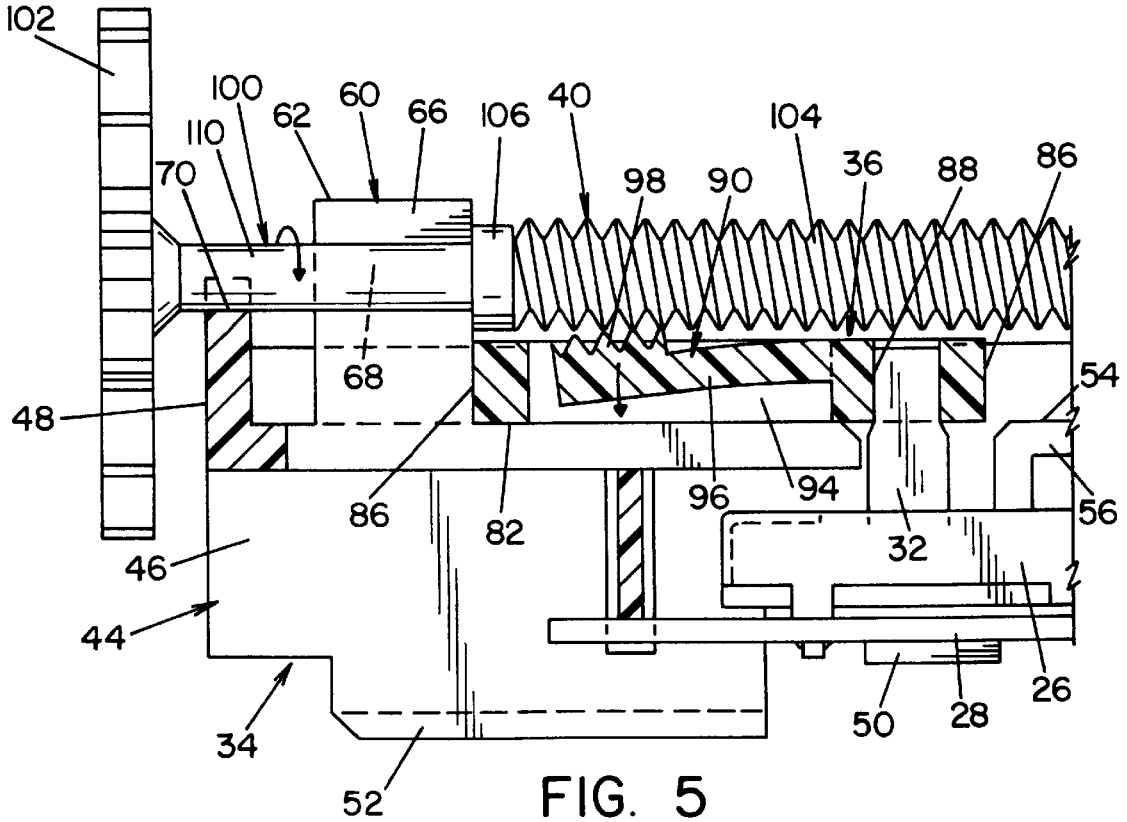
FIG. 5 is a partial, elevation cross-section of the potentiometer assembly shown in a disengaged position.

Upon installation of the potentiometer assembly 24 as shown in FIG. 5, the gear 102 is engaged and rotated by the drive gear 18. Accordingly, as the shaft 100 rotates, the slide rack 36 is moved in a linear motion, depending upon the direction of rotation of the gear 40. Accordingly, the potentiometer assembly 24 is used to determine the position of a monitored device, such as a garage door. By utilizing the shaft supports 60 as a stop, it will be appreciated that an extended rotation of the gear 40 in one direction causes the stop 86 to abut the adjacent support 60. At this time, rotation of the threaded shaft 104 forces the downward movement of the deflectable member 90 such that the threaded section 98 no longer engages the threaded shaft 104 and the slide rack moves back about one thread on the threaded section 104. Upon further rotation, the deflectable member 90 re-engages the threaded shaft 104 and if the direction of rotation continues, the deflectable member will once again become disengaged. This will repeat until the drive gear 18 stops rotating in the same direction. Upon reversal of the drive gear 18, the threaded shaft 104 rotates in the opposite direction and the slide rack 34 begins traveling toward the opposite shaft support 60. The same disengagement function described above will occur when the slide rack 34 abuts the other support 60.

The primary benefit of the potentiometer assembly 40 is that it automatically resets itself after servicing of a component in the operator system or upon installation. For example, the slide rack 36 may be initially positioned at about a mid-point within the housing 44. Movement of the door in either direction will cause the slide rack to eventually abut one of the supports 60 and stay there until the door stops moving or is reversed. When the door is reversed, the slide rack is moved in the opposite direction until the door reaches its other travel limit. Once the travel limits are defined, the relative position of the slide bar 32 is easily used to determine the position of the door, which in turn is used for force data profiles and the like.

It will be appreciated that use of the potentiometer assembly 24 provides several advantages over known devices for controlling the movement of a slide bar of the potentiometer. In particular, the present invention allows for resetting or re-positioning of the potentiometer in either direction of movement. As such, the present invention does not require additional components to disengage the potentiometer drive. And the potentiometer drive automatically re-engages when the drive reverses. Still yet another advantage of the present invention is that it requires less parts to provide its function and therefore, it is less expensive to implement than known devices which accomplish the same end.

Thus, it should be evident that the potentiometer assembly 24 and its method for providing a positional location of an attached door as disclosed herein carries out the various objects of the present invention set forth above and otherwise constitutes an advantageous contribution to the art. As will be apparent to those persons skilled in the art, modifications can be made to the preferred embodiment disclosed herein without departing from the spirit of the invention. For example, the potentiometer assembly 24 may be employed in any device in which it is desired to determine the positional location of a moving device without causing damage to the potentiometer. Moreover, the potentiometer assembly may be used in conjunction with any moving object that goes between two fixed points. Therefore, the scope of the invention herein described shall be limited solely by the scope of the attached claims.

What is claimed is:

1. An assembly for monitoring the travel of a device, comprising:

a potentiometer having a moveable member, said potentiometer generating a resistance value according to a position of said moveable member;

a bracket coupled to said potentiometer;

a threaded rotatable member carried by said bracket, said rotatable member having a threaded shaft and adapted to be coupled to the device; and a slide rack carried by said bracket, said slide rack coupled to said moveable member and said threaded rotatable member, said slide rack operatively engaged with said tbreaded, rotatable member between predetermined first and second positions and operatively disengaged from said rotatable member at said first and second positions, wherein said slide rack includes a block having an opening defining a tongue and being only linearly slidable on said bracket, said block having a threaded deflectable member, said threaded deflectable member having a section of threads on said tongue fully meshing with said rotatable threaded member between said first and second positions such that said moveable member is moved between said first and second positions, wherein at said first and second positions rotation of said threaded shaft forces deflection of said threaded deflectable member and disengagement of said section of threads from said threaded shaft to preclude linear movement of said block.

2. The assembly according to claim 1, wherein said bracket comprises:

a housing having a rack ledge with an opening therethrough, said slide rack supported by said rack ledge, said moveable member extending through said opening and engaging said slide rack.

3. The assembly according to claim 2, wherein said bracket further comprises a pair of shaft supports for receiving said threaded rotatable member.

4. The assembly according to claim 1, wherein said rotatable member further comprises:

a gear at one end of said threaded shaft, said gear adapted to be coupled to the device, said threaded shaft rotating when the device moves.

5. A device for detecting the positional location of a door that is moved between positions, comprising:

a potentiometer having a moveable member that generates a unique resistance value for each door location;

a rotatable member adapted to be coupled to the door, said rotatable member having a threaded shaft;

a bracket having a pair of shaft supports at about each end thereof, each said shaft support having a pair of opposed deflectable prongs with a detent facing said other prong, said detents forming a shaft surface for rotatable receiving said rotatable member; and a slide rack supported by said bracket and coupled to said moveable member, said slide rack having a deflectable member engaged and moved by said threaded shaft, said deflectable member disengaged from said threaded shaft when said moveable member reaches a predetermined travel limit.

6. The device according to claim 5, wherein said rotatable member further comprises:

a gear extending from one end of said threaded shaft, said gear rotated by movement of the door which in turn rotates said threaded shaft.

7. The device according to claim 6, wherein said slide rack further comprises:

a block having a bar opening which receives said moveable member;

said deflectable member having a threaded section that meshes fully with said threaded shaft, wherein rotation of said threaded shaft causes linear movement of said block and in turn said moveable member, said potentiometer changing the resistance value of said potentiometer for each new door location.

8. The device according to claim 7, wherein said block abuts one of said shaft supports when the door over travels, and wherein said threaded shaft continues to rotate and forces said deflectable member away from said threaded shaft to force disengagement thereof.

9. The device according to claim 8, wherein said threaded shaft is only completely re-engaged when rotation of said threaded shaft is reversed and said block moves away from said shaft support.

10. A screw type potentiometer drive for determining a position of a door that is moved between position is by a motor, comprising:

a potentiometer having a slidable member moveable in a linear direction, said potentiometer mounted on a circuit board which transmits a resistance value associated with a position of the door;

a bracket mounted o said circuit board, said bracket having a pair of shaft supports at each end, said bracket also having a rack ledge with an opening therethrough, said slidable member extending through said opening and extending above said rack ledge;

a slide rack supported by said rack ledge, said slide rack having a bar opening which receives said slidable member, wherein movement of said slide rack causes movement of said slidable member, said slide rack having a deflectable member with a threaded section; and a pinion gear having a threaded shaft, one end of said threaded shaft having a gear that is adapted to be coupled to the motor, said threaded shaft rotatably carried by said pair of shaft supports and meshing with said threaded section, wherein movement of the door is caused by the motor which also rotates said gear, said threaded shaft forces linear movement of said slide rack until said deflectable member disengages from said threaded shaft and stops linear movement of said slidable member, wherein said pinion gear provides a collar at each end of said threaded shaft, wherein said collars are adjacent said shaft supports and wherein each said shaft support comprises a pair of opposed deflectable prongs, each said prong having a detent facing the other said prong, said detents forming a shaft surface, and said bracket having a pair of end walls with a notch therein, said notches and said shaft surfaces forming a shaft opening in which said pinion gear rotates.

* * * * *

UNITED STATES PATENT AND TRADEMARK OFFICE

CERTIFICATE OF CORRECTION

PATENT NO. : 6,078,249
DATED : June 20, 2000
INVENTOR(S) : Scott A. Slavik and Yan Rodriguez It is certified that error appears in the above-identified patent and that said Letters Patent is hereby corrected as shown below:

Column 8,
Line 22, “tbreaded”, should be -- threaded --;
Line 63, (first occurrence) “rotatable”, should read -- rotatably --;

Column 9,
Line 30, “position is”, should read -- positions --; and

Column 10,
Line 1, “o”, should be -- to --.

Signed and Sealed this

Seventh Day of February, 2006

JON W. DUDAS
*Director of the United States Patent and Trademark Office*